US007128124B2

(12) United States Patent
Bibby et al.

(10) Patent No.: US 7,128,124 B2
(45) Date of Patent: Oct. 31, 2006

(54) ADJUSTABLE TENSION SHADE ASSEMBLY

(75) Inventors: Keith Bibby, Mansfield, MA (US); Lynn Domina, Warwick, MA (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 11/161,315

(22) Filed: Jul. 29, 2005

(65) Prior Publication Data

US 2006/0054288 A1 Mar. 16, 2006

Related U.S. Application Data

(60) Provisional application No. 60/610,309, filed on Sep. 16, 2004.

(51) Int. Cl.
*A47K 5/02* (2006.01)

(52) U.S. Cl. ..... 160/263; 160/313

(58) Field of Classification Search ..... 160/263, 160/313, 323.1; 211/105.4, 105.5, 105.6; 248/578, 266, 405, 125.8
See application file for complete search history.

(56) References Cited

U.S. PATENT DOCUMENTS

| | | | | |
|---|---|---|---|---|
| 0,473,990 | A | 5/1892 | Wilkinson | |
| 0,527,273 | A | 10/1894 | Fowler et al. | |
| 0,730,292 | A | 6/1903 | O'Keefe | |
| 1,049,485 | A * | 1/1913 | Hoyt | 160/263 |
| 1,090,931 | A | 3/1914 | McLean | |
| 1,170,068 | A | 2/1916 | Hoyt | |
| 1,203,455 | A * | 10/1916 | Baker | 160/325 |
| 1,233,884 | A | 7/1917 | Kraemer et al. | |
| 1,238,642 | A * | 8/1917 | Crump | 160/263 |
| 1,258,940 | A | 3/1918 | Paul | |
| 1,639,551 | A | 8/1927 | Booth | |
| 1,688,563 | A | 10/1928 | Tomlinson | |
| 1,792,846 | A | 2/1931 | Laraway | |
| 1,881,037 | A | 10/1932 | Vuchetich | |
| 2,032,842 | A | 3/1936 | Gould | |
| 2,079,267 | A * | 5/1937 | Vroom et al. | 211/105.4 |
| 2,110,048 | A | 3/1938 | May | |
| 2,307,095 | A | 1/1943 | Zaferakis | |
| 2,973,870 | A | 3/1961 | Schoos | 211/123 |
| 3,203,468 | A | 8/1965 | Gossling et al. | |
| 3,299,944 | A | 1/1967 | Gossling et al. | |
| 3,853,170 | A | 12/1974 | Barettella | 160/323 |
| 4,118,087 | A * | 10/1978 | Dorf | 312/291 |
| 4,147,199 | A * | 4/1979 | Cameron | 160/330 |
| 4,373,569 | A | 2/1983 | Barettella | 160/263 |
| 4,438,799 | A | 3/1984 | Comeau | 160/263 |
| 4,492,263 | A * | 1/1985 | Gebhard | 160/228 |
| 5,203,395 | A | 4/1993 | Koller et al. | 160/263 |
| 5,881,792 | A | 3/1999 | Cheng | 160/263 |

* cited by examiner

*Primary Examiner*—Blair M. Johnson
(74) *Attorney, Agent, or Firm*—Barlow, Josephs & Holmes, Ltd.

(57) ABSTRACT

The adjustable tension shade includes a spring motor, an axle, and a shade roller. The spring motor is mounted to the axle and drives the shade roller. The axle has an adjustable telescoping shaft and the free ends of the axle are spring-biased outwardly away from each other. The shade roller has a tubular body that surrounds the axle and the spring motor and serves as a mounting point and storage unit for a shade. A pair of feet is connected to each end of the axle and each has a soft rubber gripping surface thereon.

11 Claims, 6 Drawing Sheets

ADJUSTABLE TENSION SHADE ASSEMBLY

BACKGROUND OF THE INVENTION

1. Field of the Invention

The present invention generally relates to window shades. More specifically, the present invention relates to spring tension mounted window shades.

2. Background of the Related Art

In the home improvement and construction industries, there is a desire to make a window more pleasing to the eye, to provide some type of shade to the sun and to provide privacy, as needed. Windows are available in many different sizes thereby necessitating that the window shade be fit to the window casement at hand. As a result, numerous sizes of window shades must be available to fit a given window. This is particularly problematic in connection with the sale of such shades because different sizes of shades must be available for purchase to fit the different sizes of windows. Windows of uncommon sizes require custom built shades.

In the prior art, there have been many attempts to address the problem of fitting a shade to a window. U.S. Pat. No. 473,990 (Wilkinson) provides such a spring tension shade that includes spring-loaded pads on opposing ends of the shade to frictionally grip the facing sides of a window casement. However, the main body must generally fit within the width of the casement thereby. This device is not intended to fit to a wide range of window sizes. The focus of this invention is simply to removably attach a window shade to a window casement without the use of tools or mounting hardware. U.S. Pat. No. 4,373,569, issued to Barretella, similarly provides for a window shade assembly that can be easily installed and which is held in place by friction.

These prior art assemblies, however, suffer from the disadvantage of being of a substantially fixed length. The play in the spring-biased pads on the opposing ends of the assembly is minimal. As a result, the prior art assemblies are specifically made for installation into a specific sized window casement.

Therefore, there is a desire to provide a single spring tension shade assembly that can be installed into windows of a wide range of sizes. There is a desire to provide to the consumer with a single shade assembly that can be easily adjusted to fit a given window Another disadvantage of prior art shade rollers is that the holding force exerted by the ends of the assembly is through the roller itself. This means that there is increased friction that keeps the roller from turning freely. As the holding force increases, the force necessary to operate the roller thereby increases making it harder to furl or unfurl the shade. The increase in the force necessary to operate the shade necessitates that the holding force must be increased to keep the shade assembly secure within the window casement.

Therefore, there is a need for a tension shade assembly that minimizes or reduces the forces exerted on the roller itself to prevent the jamming or the rotation of the roller or the dislodgment of the tension shade assembly from the window casement.

SUMMARY OF THE INVENTION

The present invention solves the problems associated with the prior art shade assemblies. The adjustable tension shade of the present invention includes a shade roller having a tubular body and a telescoping spring-biased axle. The shade roller has a first portion that slidably resides within a second portion to form the shade roller. The axle has a axle body portion and an adjustment rod portion that is received therein. The axle body portion has an adjustment spring contained therein. The adjustment rod portion has a raised shoulder that cooperates with the adjustment spring contained in the axle body portion to position the adjustment rod therein. The adjustment spring urges the free ends of the axle away from each other. As a result, the axle body member can be retained within a window casement by friction in similar fashion to a standard spring tension curtain rod. The ends of the axle have cushioned footings attached thereon to retain the entire assembly in place without damaging the window casement walls.

Unlike a curtain rod, the second (outer) portion of the tubular body member is also fitted with a spring motor. Thus, a shade can be attached thereto so it can be rolled in similar fashion to a typical spring tension shade, such as that depicted in the Wilkinson '990 patent discussed above.

However, the shade assembly of the present invention can be adjusted in width across a wide range to accommodate window casements of different sizes. The shade assembly is fit to a given window and then the shade itself is selected to fit to the adjusted to length. The shade member can be cut to the size and then attached directly onto the second (outer) tubular member so that it can be wound thereabout, as desired. However, it is also possible to provide a window shade member that can be sized by the user without cumbersome cutting. As seen in U.S. Pat. No. 4,438,799, issued to Comeau and commonly owned with the instant invention, a shade of adjustable width, using tear-way strips, can be used in conjunction with the present invention to facilitate the sizing of the shade member. Using the easy-adjusting shade member of Comeau '799, the shade assembly can be provided in a single kit for a consumer to custom install and fit a shade assembly into a wide range of window casement sizes.

Accordingly, it is an object of the present invention to provide an adjustable tension shade rod that can be easily adjusted to fit a range of window sizes.

Another object of the present invention is the provision for an adjustable tension shade rod that can be mounted to a window casement without the need for special mounting hardware.

Yet another object of the present invention is the provision for an adjustable tension shade that can be mounted to a window casement without damaging the window casement.

Yet another object of the present invention is the provision for an adjustable tension shade that minimizes the lateral forces on the roller of the tension shade thereby preventing jamming or dislodgment of the tension shade from the window casement.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENTS

The adjustable tension shade rod of the present invention is shown generally at 10 in FIGS. 1–7. As will hereinafter be more fully described, the present invention provides an inexpensive adjustable tension shade rod that can be adjusted to fit many windows of varying dimensions without the need for additional mounting hardware and without damaging the window casement walls.

Figure 1:
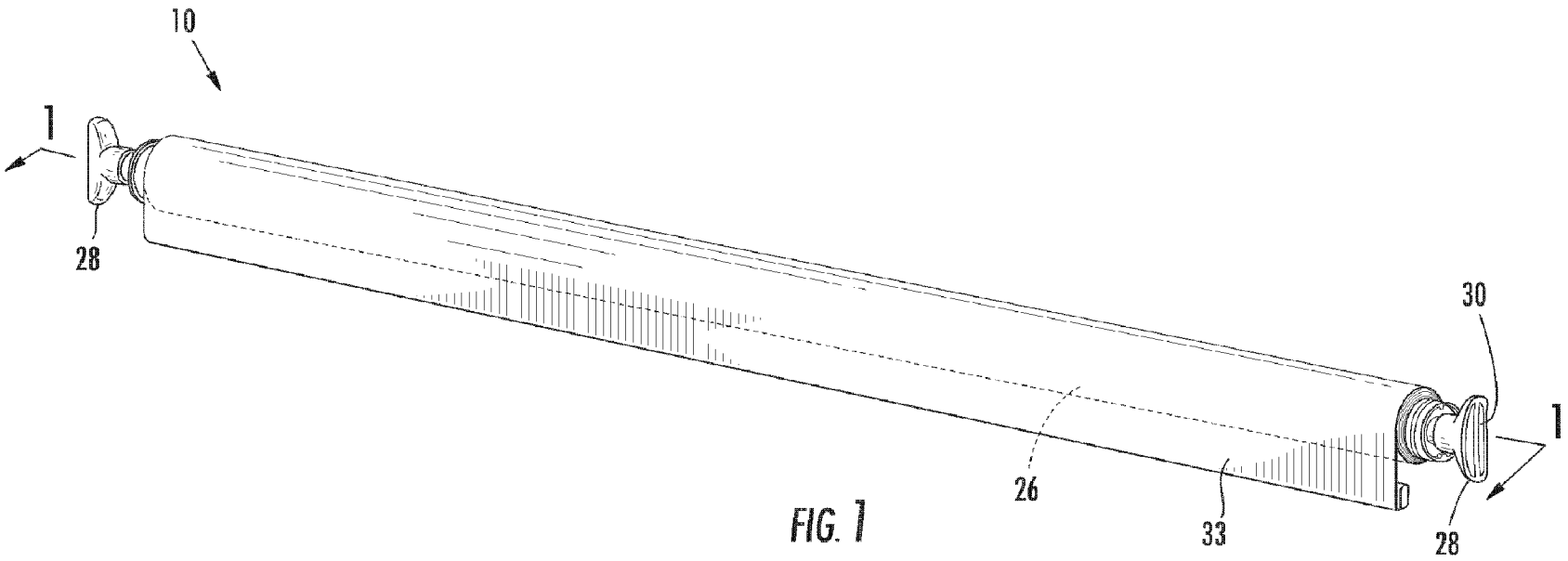
FIG. 1 is a perspective view of the preferred embodiment of the tension shade assembly of the present invention.

Referring first to FIG. 1, a front perspective view of the spring tension rod assembly 10 of the present invention is shown to include a telescoping shade roller 26 with a foot 28 on each opposing sides thereof. As will be described in detail below, the shade roller 26 is rotatably mounted relative to each foot 28. A grip surface 30 is provided on the ends of each foot 28 is a grip surface for communicating with a mount surface, such as a window casement. A shade 33 is wound about the shade roller 26. FIG. 1 illustrate the shade 33 fully would about the shade roller 26.

Figure 2:
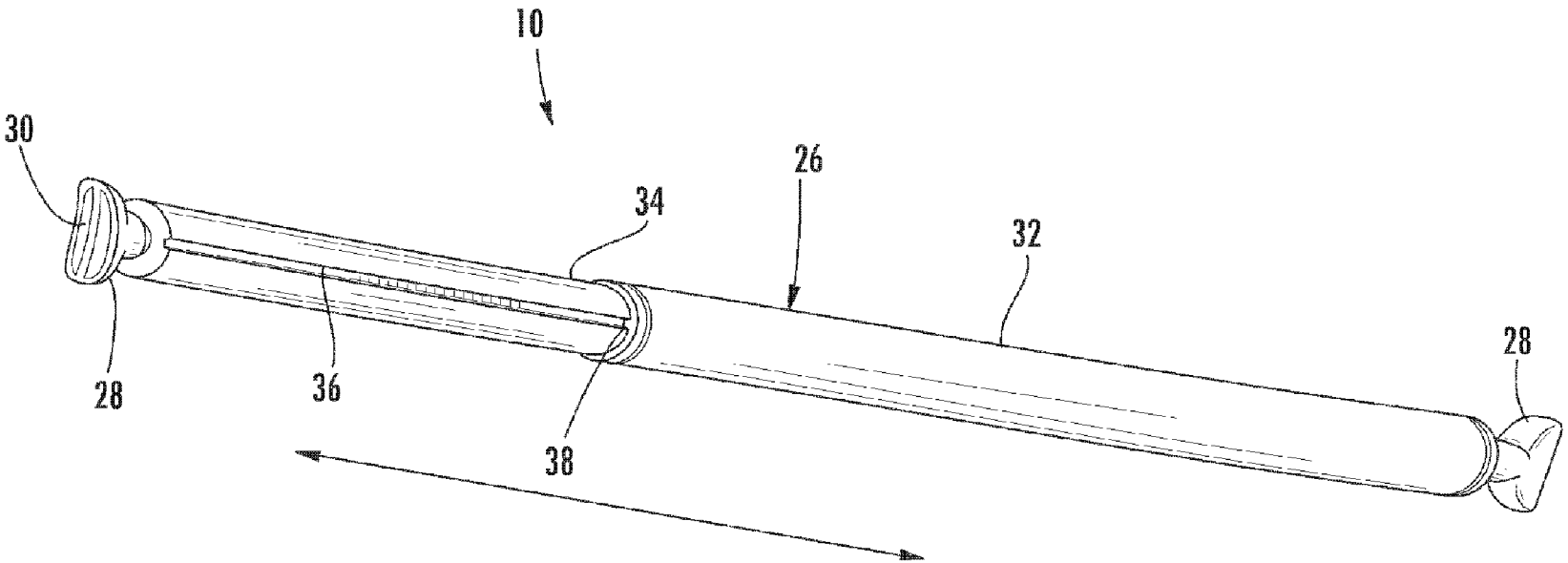
FIG. 2 is a perspective view of the preferred embodiment of the tension shade assembly of the present invention with the shade member removed.
Figure 4:
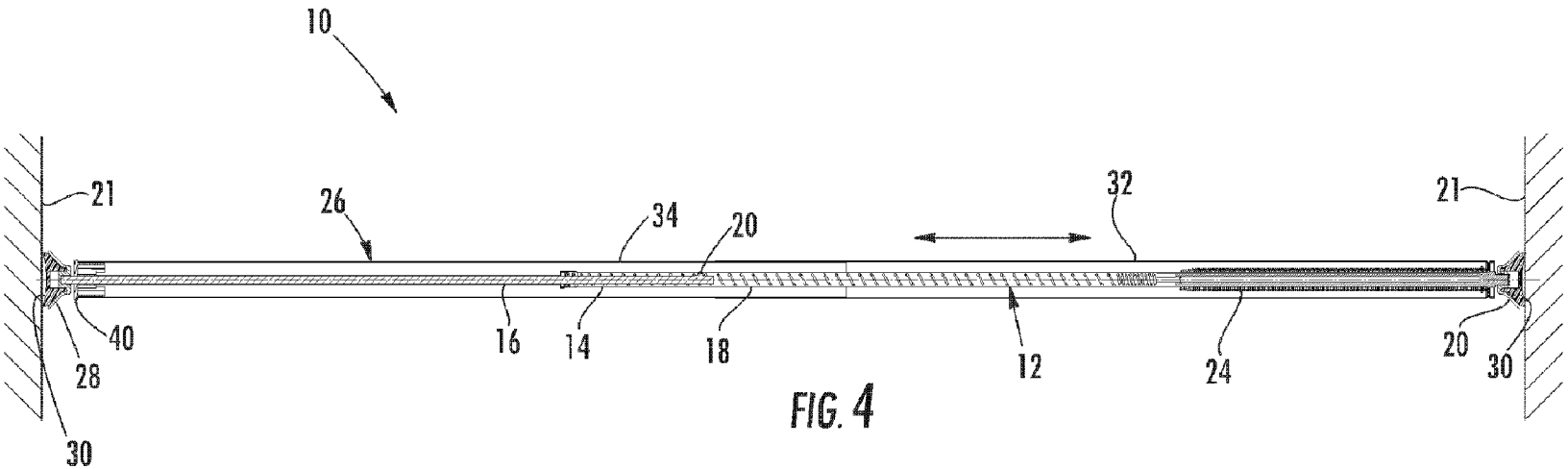
FIG. 4 is a side cross-section view through line 1—1 of FIG. 1.
Figure 5:
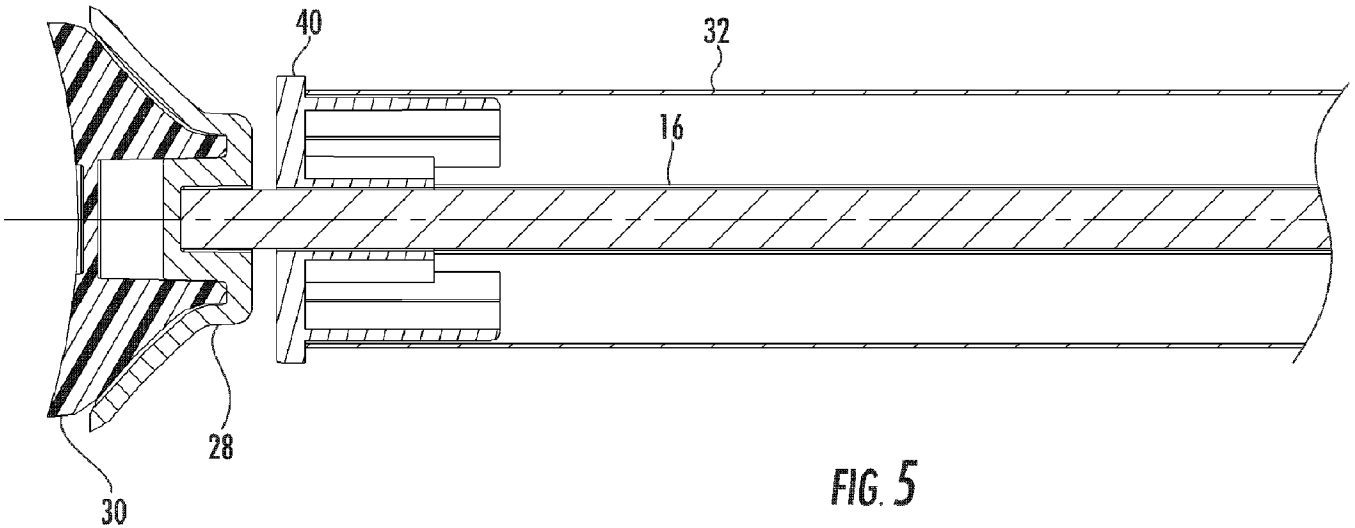
FIG. 5 is a close-up side cross-section view of the adjustable end of the preferred embodiment shown in FIG. 4.

Turning now to FIG. 2, the spring tension rod assembly of FIG. 1 is shown without shade 33 for ease of discussion. As will be described in detail below, first portion 32 and second portion 34 of shade roller telescope relative to one another while still being able to carry shade 33, as seen in FIG. 1. Thus, as seen in FIG. 4, the spring tension shade assembly 10 can be easily compressed laterally so that it may clear past the sides of a window casement, then positioned as desired and then released so it may be frictionally, yet removably, retained in place.

Turning now to FIG. 3–7 further details of the invention are set forth. The adjustable tension shade assembly 10 of the present invention has an axle 12 that has an adjustable telescoping shaft. The axle 12 includes an axle body portion 14 and an adjustment rod portion 16. The axle body portion 14 is preferably an open seam roll-formed tube, but other construction techniques could be used. The axle body portion 14 has an adjustment spring 18 contained therein that extends the length of the axle body portion 14. The adjustment spring 18 is retained within the axle body portion 14 by selectively crimping the axle body portion 18, but other techniques could be used equally effectively. The adjustment rod portion 16 includes a raised shoulder 20 on one end, which can best be seen in FIG. 6. The raised shoulder 20 can be formed, preferably of metal, by a number of methods that one skilled in the art would appreciate, including stamping, integrally molding or turning upwardly one end of the adjustment rod portion 16 among others. Other materials and manufacturing techniques may be used for the adjustment rod portion 16. Most preferably, the raised shoulder 20 is formed by stamping the adjustment rod portion 16 near one end, leaving a small portion 22 extending beyond the raised shoulder 20.

Figure 6:
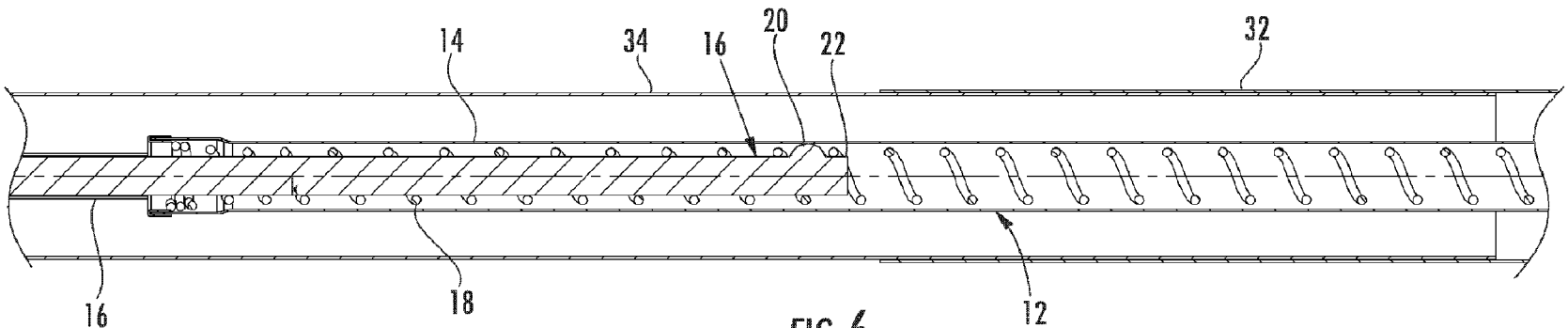
FIG. 6 is a close-up side cross-section view of the middle portion of the preferred embodiment shown in FIG. 4.

As seen in FIG. 6, the adjustment rod portion 16 is slidably received into the axle body portion 14 and threaded into the adjustment spring 18 contained therein. The raised shoulder 20 serves a guide within the coils of the adjustment spring 18 to keep the adjustment rod portion 16 from moving freely within the axle body portion 14 or becoming dislodged entirely. By turning the adjustment rod portion 16, it can be threaded in or out of the axle body portion 14 to the length that is desired to fit the entire assembly 10 into a particular window casement 21. The small portion 22 of the adjustment rod portion 16 extending beyond the raised shoulder 20 serves to stabilize the adjustment rod portion 16 within the adjustment spring 18 and axle body portion 14 of the axle 12 and prevents the raised shoulder 20 from jumping the coils of the adjustment spring 18. The adjustment spring 18 also urges the adjustment rod portion 16 out and away from the axle body portion 14 and thus urges the free ends of the axle 12 away from each other. A metal coil spring is preferably used to spring-bias the axle to an extended telescoped condition. Other spring-biasing structures may be used for this purpose.

Figure 7:
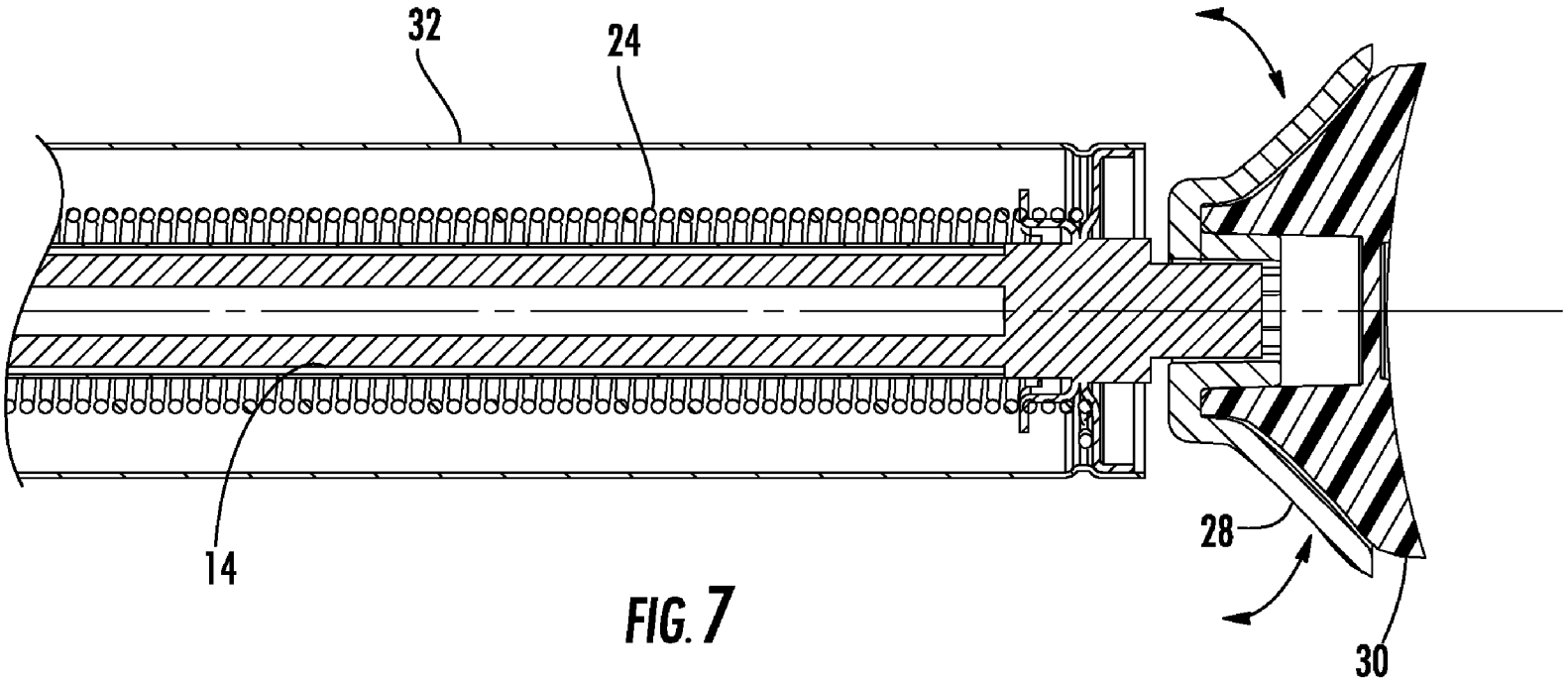
FIG. 7 is a close-up side cross-section view of the spring-motor end of the preferred embodiment shown in FIG. 4.

Turning now to FIG. 7, a spring motor 24 is connected to one end of the axle body portion 14 of the axle 12 and serves to drive the shade roller 26, described below, during operation of the adjustable tension shade assembly 10. In particular, the spring motor 24 is coupled to the axle body portion 14 of the axle 12 by interfitting the spring motor 24 into and over one end of the tube formed by the axle body portion 14. The axle 12 remains stationary while the spring motor 24 furls and unfurls the shade 33 on the shade roller 26. Spring motors 24 are well-known in the art and one skilled in the art would be capable of selecting or constructing an appropriate spring motor 24 to drive the adjustable tension shade assembly 10 of the present invention. Therefore, the spring motor 24 need not be discussed in further detail herein.

Referring back to FIGS. 1 and 4, attached to each end of the axle is a foot 28. Each foot 28 serves to secure the adjustable tension shade assembly 10 against the window casement 21 without the use of additional mounting hardware. Although optional, each foot 28 preferably includes a soft rubber, or rubber-like, grip surface 30 to prevent damage to the underlying wall of the window casement 21. Each grip surface 30 enhances the friction fit of the adjustable tension shade assembly 10 in the window casement 21 and prevents its slippage therefrom. Optionally, each foot 28 may further be pivotally mounted to the axle 12 to allow the adjustable tension shade assembly 10 to be fit into a window casement 21 that has walls that are not plumb or otherwise have uneven surfaces.

As best seen in FIGS. 3–6, received over the axle 12 is a shade roller 26 that has a tubular body. The shade roller 26 includes a first portion 32 and a second portion 34. The second portion 34 is slidably received into the first portion 32 and enables the shade roller 26 to be adjusted to the desired length of the axle 12. After the axle 12 has been adjusted to the desired length as described above, the shade roller 26 is extended or retracted as appropriate to correspond to the length of the axle 12. A shade 33, shown in FIG. 1 but omitted from the other figures for ease of description, is attached to the shade roller 26 and is furled and deployed as desired.

Once the tension shade assembly 10 is sized to a given window casement 21 or other mounting structure, the shade 33 of the appropriate width can be secured to the shade roller 26. As described above, the appropriate width may be achieved by cutting the shade, for example.

Referring back to FIG. 2, the shade roller 26 further includes a groove 36 on the first portion 32 that engages a tongue 38 on the second portion 34. The engagement of the tongue 38 with the groove 36 prevents the rotational movement of either portion 32, 34 relative to the other. This feature is commonly referred to as "keying." This keying the portions 32, 34 of the shade roller 36 prevents the adjustable tension shade assembly 10 from malfunctioning during its operation. As would be appreciated by one skilled in the art, the use of a tongue 38 and a groove 36 are but one implementation that one could use to "key" the portions 32, 34 of the shade roller 26 together.

Figure 3:
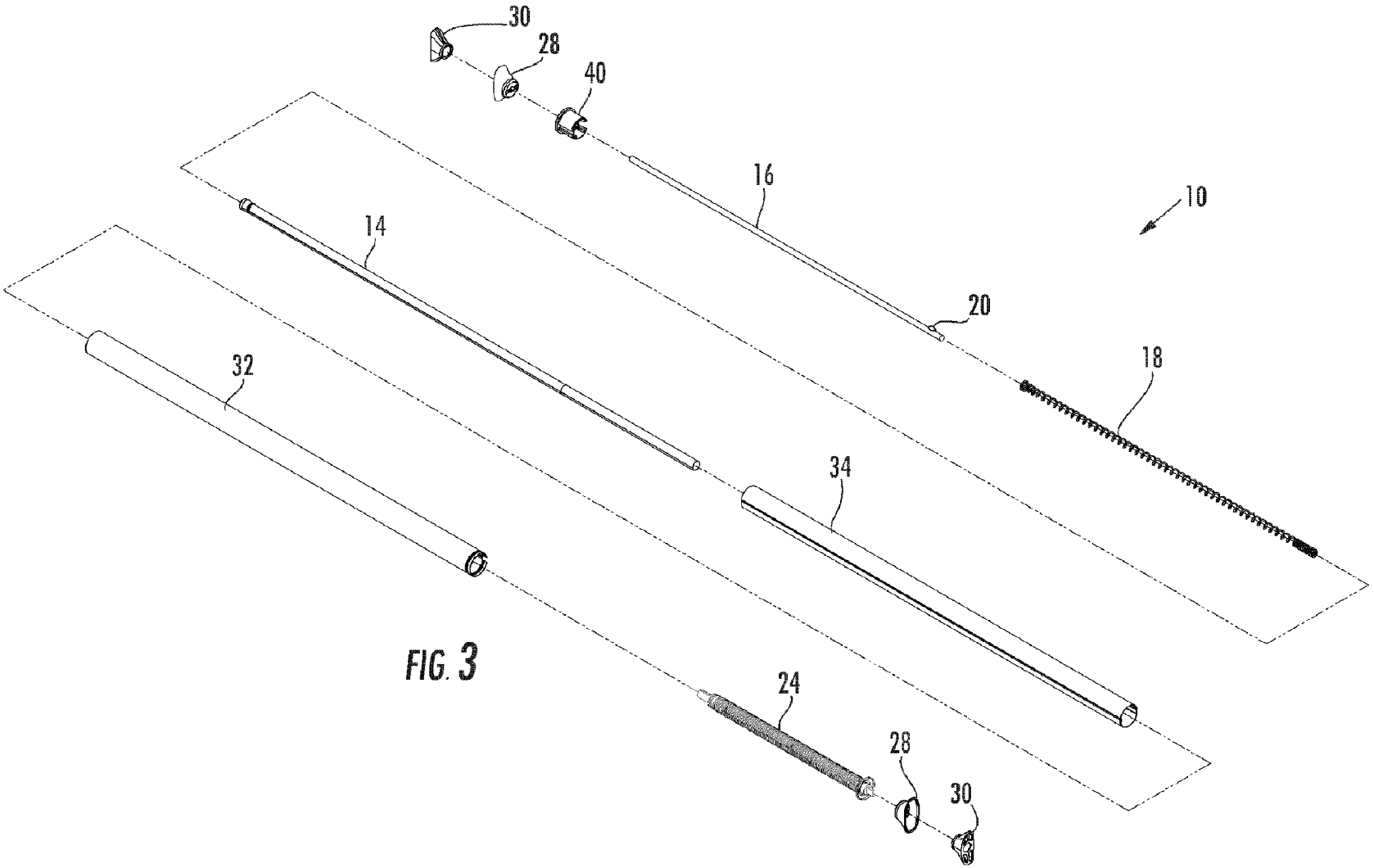
FIG. 3 is a exploded view of the preferred embodiment of the tension shade assembly of the present invention.

In FIGS. 3 and 4, an end cap 40 is frictionally fit into the free end of the second portion 34 of the shard roller 26 and serves to support the shade roller 26 on the adjustment rod portion 16 of the axle 12.

It can therefore be seen that the present invention provides a simple, yet inexpensive, adjustable tension shade that can be mounted in a variety of window casements and without damaging the window casement or the need for additional hardware. For these reasons, the instant invention is believed to represent a significant advancement in the art that has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claim.

What is claimed is:

1. An adjustable tension shade assembly, comprising:

an axle having an adjustable telescoping shaft and opposing free ends, the free ends of the axle being spring-biased outwardly away from each other;

the adjustable telescoping shaft of the axle having a tubular body portion, an adjustment spring contained in the tubular body portion of the axle, and an adjustment rod portion received within the adjustment spring, the adjustment rod portion having a raised shoulder that cooperates with the adjustment spring to position the adjustment rod portion within the tubular body portion;

a spring motor mounted on the axle;

a shade roller, having a tubular body, being driven by the spring motor;

the axle and the spring motor being surrounded by the shade roller; and a pair of feet respectively connected to the opposing free ends of the axle.

2. The adjustable tension shade assembly of claim 1, wherein at least one of the pair of feet is pivotably connected to its respective free end of the axle.

3. The adjustable tension shade assembly of claim 1, wherein the adjustment spring outwardly urges the opposing free ends of the axle away from each other.

4. The adjustable tension shade assembly of claim 1, wherein the tubular body of shade roller further comprises:

a first portion; and a second portion slidably received within the first portion.

5. The adjustable tension shade assembly of claim 4, wherein the first portion and second portion include complimentary keying members to prevent rotational movement of the first portion relative to the second portion.

6. The adjustable tension shade assembly of claim 1, wherein each of the pair of feet further comprises a soft grip attached thereto.

7. The adjustable tension shade assembly of claim 1, further comprising a shade wound about the shade roller.

8. An adjustable tension shade assembly, comprising:

an axle having two opposing free ends, a telescoping adjustment rod portion and a tubular body portion; the tubular body portion having an adjustment spring contained therein, the adjustment rod portion having a raised shoulder and being received into the tubular body portion, the raised shoulder of the adjustment rod portion cooperating with the adjustment spring to position the adjustment rod portion within the tubular body portion; the adjustment spring outwardly urging the opposing free ends of the axle away from each other;

a spring motor mounted on the axle;

a shade roller driven by the spring motor, the shade roller having a tubular body member surrounding the axle and the spring motor, the tubular body member having a first portion and a second portion slidably received therein, the first portion and second portion having keyed openings to prevent rotational movement of the first portion relative to the second portion; and a pair of feet connected to its respective opposing free end of the axle.

9. The adjustable tension shade assembly of claim 8, wherein at least one of the pair of feet is pivotably connected to its respective opposing free end of the axle.

10. The adjustable tension shade assembly of claim 8, wherein each of the pair of feet further comprises a soft grip attached thereto.

11. The adjustable tension shade assembly of claim 8, further comprising a shade wound about the shade roller.

* * * * *